US005441443A

United States Patent [19]

Roberts

[11] Patent Number: 5,441,443

[45] Date of Patent: Aug. 15, 1995

[54] APPARATUS FOR BLAST CLEANING SURFACES DISPOSED AT ANGLES WITHIN 45 DEGREES OF VERTICAL

[75] Inventor: Jerry W. Roberts, Oklahoma City, Okla.

[73] Assignee: Nelco Manufacturing Corp., Oklahoma City, Okla.

[21] Appl. No.: 150,511

[22] Filed: Nov. 10, 1993

[51] Int. Cl.[6] ..... B24C 3/06

[52] U.S. Cl. ..... 451/91; 451/92; 451/95; 451/100

[58] Field of Search ..... 451/75, 91, 92, 94, 451/95, 99, 100, 38, 39, 40

[56] References Cited

U.S. PATENT DOCUMENTS

| | | | |
|---|---|---|---|
| 923,100 | 5/1909 | Young . | |
| 2,204,610 | 6/1940 | Minich et al. . | |
| 2,254,234 | 9/1941 | Minich . | |
| 3,034,262 | 5/1962 | Pawlson . | |
| 3,900,969 | 8/1975 | Diehn . | |
| 3,906,673 | 9/1975 | Goto et al. . | |
| 4,020,596 | 5/1977 | Bergh . | |
| 4,364,823 | 12/1982 | Goff | 209/135 |
| 4,416,092 | 11/1983 | Nelson | 51/425 |
| 4,693,041 | 9/1987 | Dickson | 51/432 |
| 4,894,959 | 1/1990 | Hoover | 51/432 |
| 5,090,162 | 2/1992 | Nelson | 51/429 |
| 5,142,831 | 9/1992 | Nelson | 51/429 |
| 5,204,084 | 4/1993 | Roberts | 51/429 |

FOREIGN PATENT DOCUMENTS

| | | |
|---|---|---|
| 0032161 | 7/1981 | European Pat. Off. . |
| 2203368 | 10/1988 | United Kingdom . |

*Primary Examiner*—Maurina T. Rachuba

[57] ABSTRACT

A blast cleaning machine which gravity feeds abrasive material when blasting at positions from angularly upward to angularly downward. The machine includes a housing, a blast assembly, a motor for rotatably driving the blast assembly and a hopper. The housing has a blast corridor, a return corridor and a blast opening communicating with the blast corridor and the return corridor. The blast assembly receives abrasive material from the hopper and propels the abrasive material through the blast corridor and blast opening against the surface to be blast cleaned. The hopper has straight walls which are substantially parallel with the blast opening for gravity feeding abrasive material straight into the blast assembly. The walls of the hopper provide effective gravity feeding of abrasive material to the blast assembly when the machine is blasting anywhere between a 45-degree angle upward and a 45-degree downward.

19 Claims, 3 Drawing Sheets

APPARATUS FOR BLAST CLEANING SURFACES DISPOSED AT ANGLES WITHIN 45 DEGREES OF VERTICAL

BACKGROUND OF THE INVENTION

1. Field of the Invention

The present invention relates generally to apparatus for blast cleaning surfaces, and particularly to a machine for blast cleaning surfaces disposed at angles within approximately 45 degrees of vertical.

2. Description of Related Art

Various apparatus for blast cleaning vertical surfaces are known in the art. For example, U. S. Pat. No. 3,900,969 issued to Diehn discloses a portable apparatus for blast cleaning. If the Diehn machine is rotated 45 degrees from vertical, the path of abrasive material from the hopper to the blast wheel includes a horizontal portion which prevents gravity feed of the abrasive material. Accordingly, an apparatus like the Diehn machine cannot be used effectively to blast clean curved structures such as water towers and ship hulls.

SUMMARY OF THE INVENTION

A blast cleaning machine constructed in accordance with the present invention includes a housing, a blast wheel, a motor for rotating the blast wheel and a hopper. The housing has a blast corridor, a return corridor and a blast opening which communicates with the blast corridor and the return corridor.

The hopper is connected to the blast corridor to supply abrasive material to the blast wheel. The hopper also communicates with the return corridor to recover spent abrasive material for reuse.

In order to gravity feed abrasive material when positioned at 45 degrees from vertical, the hopper has a rear wall which is substantially parallel with the blast opening. Furthermore, the rear wall extends into the blast corridor along a straight line path.

An object of the present invention is to provide a machine which gravity feeds abrasive material to blast clean a surface at any angle within 45 degrees of vertical.

Other objects, features and advantages of the present invention are apparent from the following detailed description when read in conjunction with the accompanying drawings and appended claims.

DETAILED DESCRIPTION OF THE PREFERRED EMBODIMENT

Figure 1:
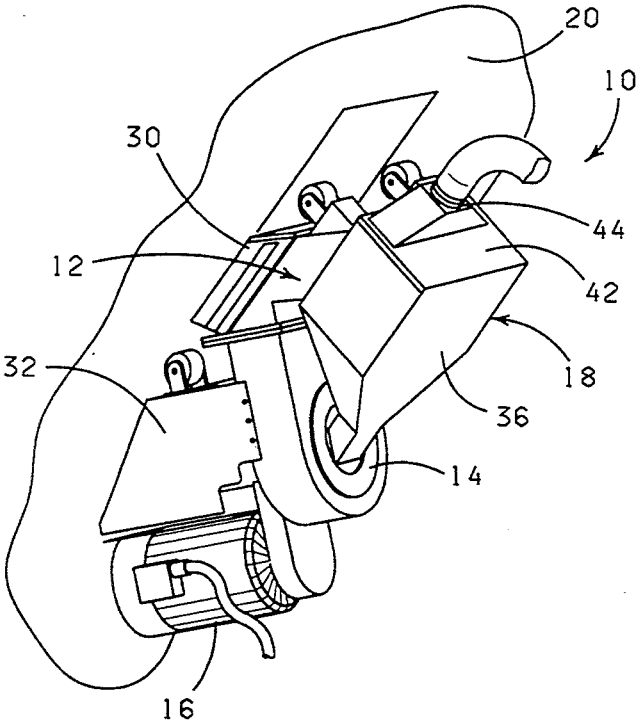
FIG. 1 is a perspective view of a blast cleaning machine constructed in accordance with the present invention.
Figure 2:
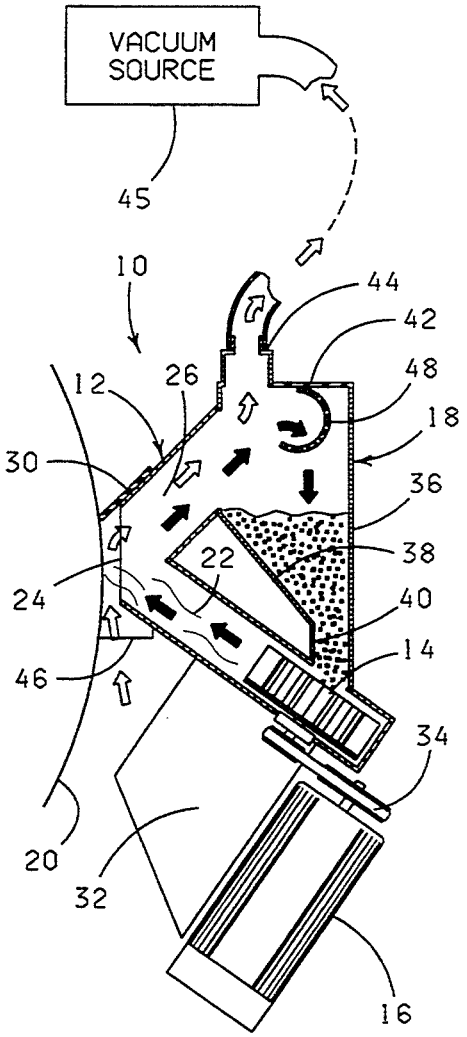
FIG. 2 is a partly sectional, partly diagrammatical side view of the blast cleaning machine of FIG. 1. The machine is positioned to blast laterally against a substantially vertical portion of a surface.
Figure 3:
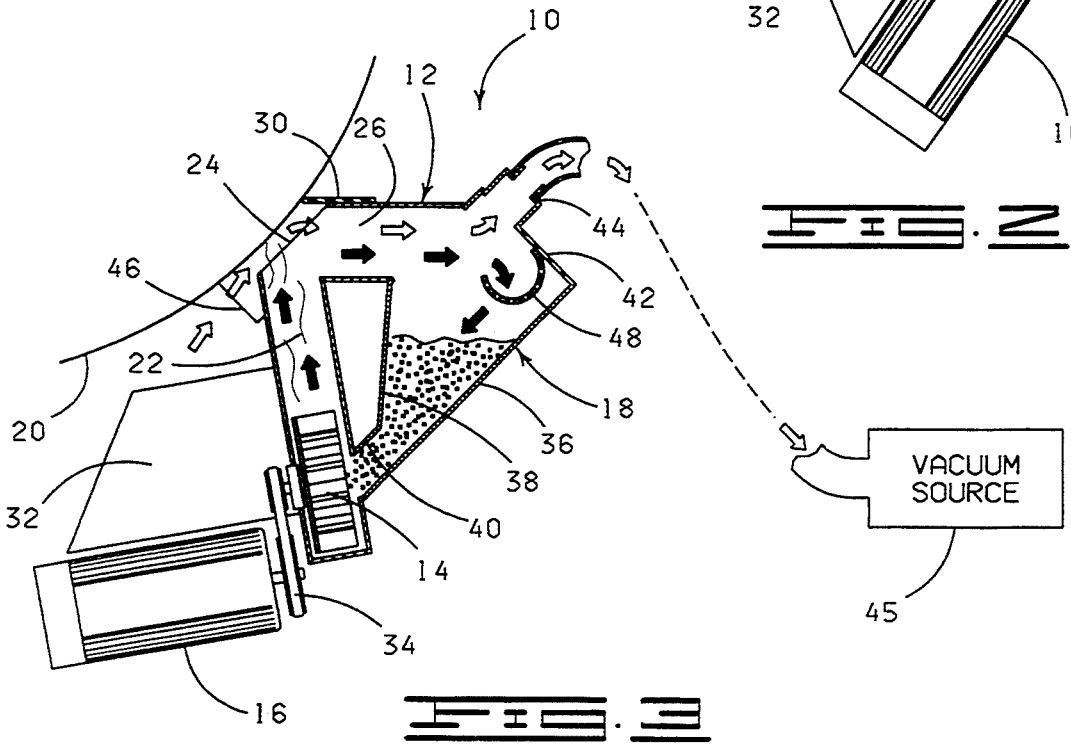
FIG. 3 is a partly sectional, partly diagrammatical side view of the blast cleaning machine of FIG. 1. The machine is positioned to blast angularly upward.
Figure 4:
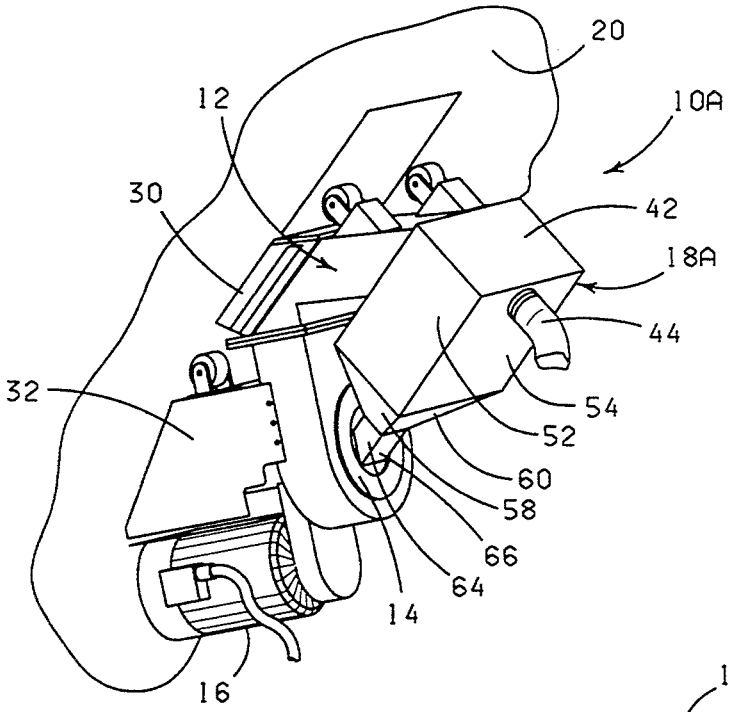
FIG. 4 is a perspective view of another embodiment of a blast cleaning machine constructed in accordance with the present invention.

Referring to the drawings in general, and to FIGS. 1 through 3 in particular, shown therein and designated by the general reference numeral 10 is a blast cleaning machine, which includes a housing 12, a blast assembly 14, a motor 16 and a hopper 18. The machine 10 is particularly adapted for blast cleaning a surface 20 which is disposed anywhere between a substantially vertical position (FIG. 2) and 45 degrees under the vertical position (FIG. 3).

As best illustrated by FIGS. 2 and 3, the housing 12 has a blast corridor 22, a blast opening 24 and a return corridor 26. The blast corridor 22 communicates with the blast opening 24 in order for abrasive material (indicated by solid arrows) to be propelled through the blast corridor 22 and the blast opening 24 against the surface 20 to be blast cleaned.

Furthermore, the return corridor 26 communicates with the blast opening 24 to recover abrasive material rebounding from the surface 20. An elastomeric seal 30 is typically secured to the housing 12 to surround the blast opening 24. The elastomeric seal 30 deforms against the surface 20 to prevent abrasive material from escaping between the surface 20 and the housing 12.

The blast assembly 14 typically includes a blast wheel disposed within the blast corridor 22 and having a plurality of radially extending blades for propelling abrasive material when the blast wheel is rotated. Such blast wheel devices are known in the art and the blast assembly 14 may comprise any conventional device which operates in a manner consistent with the functions disclosed herein.

The motor 16 is mounted to a motor bracket 32, which is secured to the housing 12. The motor bracket 32 locates the motor 16 in proper position for providing rotation to the blast assembly 14. The motor 16 may be an electric motor, a hydraulic motor, a pneumatic impeller or any other suitable rotating drive unit.

The motor 16 is typically adapted to drive the blast assembly 14 through a drive belt 34. Any arrangement of direct or indirect drive may be utilized with the motor 16 and blast assembly 14. The rotational speed of the blast assembly 14, however, should be sufficient to propel abrasive material with enough velocity to blast clean the subject surface 20.

The hopper 18 communicates with the blast corridor 22 to supply abrasive material to the blast assembly 14. The hopper 18 has a rear wall 36 which is substantially parallel with the cross-sectional plane of the housing 12 at the blast opening 24. Moreover, the rear wall 36 extends in straight line fashion all the way to the housing 12.

Furthermore, the hopper 18 has a front sloped wall 38 and a front parallel wall 40. The parallel wall 40 is parallel to the rear wall 36 and extends straight to the blast assembly 14.

The sloped wall 38 extends straight from the return corridor 26 of the housing 12 to the parallel wall 40. The sloped wall 38 is typically positioned at an angle of about 45 degrees to the parallel wall 40. Of course, the hopper 18 also has walls to enclose the sides of the hopper 18.

With this construction, the hopper 18 provides effective gravity feeding of abrasive material straight into the blast corridor 22 and blast assembly 14. Efficient gravity feeding is achieved whether the machine 10 is blast cleaning a substantially vertical surface 20 (FIG. 2) or blasting upward at a 45 degree angle (FIG. 3).

In the position shown in FIG. 2, abrasive material falls along the sloped wall 38 toward the rear wall 36. Then the fall of the abrasive material is guided straight into the blast assembly 14 by the rear wall 36 and the parallel wall 40.

In the position illustrated by FIG. 3, abrasive material falls along the rear wall 36. Then the fall of the abrasive material is directed straight into the blast assembly 14 by the parallel wall 40 and the rear wall 36.

As shown in FIGS. 1 through 3, the top 42 of the hopper 18 is provided with a vacuum duct 44. A conventional vacuum source 45 is attached to the vacuum duct 44 to create an air flow (designated by hollow arrows) for drawing dust and light debris from the machine 10. The air flow also aids in returning abrasive material from the blast opening 24 through the return corridor 26 and into the hopper 18.

An air louvre 46 is installed in the housing 12 to allow air to be drawn into the blast corridor 22. The air louver 46 is typically adjustable to moderate the amount of air flow from the blast corridor 22 through the return corridor 26.

Within the hopper 18, a half pipe 48 extends from the top 42 across the hopper 18. A lower portion of the half pipe 48 is perforated to allow abrasive material to fall through the half pipe 48. With this arrangement, debris which is too heavy to remain entrained in the air flow may be trapped by the half pipe 48 and segregated from the abrasive material.

OPERATION

The operation of the blast cleaning machine 10 should be apparent from the disclosure hereinabove. Abrasive material gravity feeds from the hopper 18 into the blast assembly 14. The blast wheel of the blast assembly 14 is rotated to propel the abrasive material through the blast corridor 22 and blast opening 24 against the surface 20.

After striking the surface 20, the abrasive material rebounds into the return corridor 26. Assisted by the air flow, the abrasive material travels from the return corridor 26 into the hopper 18 for reuse.

As discussed hereinabove, the hopper 18 provides efficient gravity feed of abrasive material for a range of machine positions between those illustrated by FIGS. 2 and 3. Accordingly, the machine 10 is well suited for curved surfaces like the hulls of ships.

It should be appreciated that the hopper 18 may gravity feed abrasive material when the machine 10 is oriented in some positions outside the range defined by FIGS. 2 and 3. However, the capability of the hopper 18 to gravity feed abrasive material to the blast assembly 14 is increasingly diminished as the machine 10 is oriented farther outside the range of positions defined by FIGS. 2 and 3.

EMBODIMENT OF FIGS. 4 THROUGH 7

In blast cleaning a structure like the mid-section of a spherical or spheroidal water tower, it is necessary to blast angularly downward as well as angularly upward. Accordingly, it is desirable that the hopper of a machine for this purpose be able to gravity feed abrasive material when the machine is blasting anywhere from approximately 45 degrees downward to about 45 degrees upward.

With reference now to FIGS. 4 through 7, shown therein and designated by reference character 10A is machine constructed in accordance with the present invention for blast cleaning at a range of positions from angularly upward to angularly downward. The machine 10A is like the machine 10 described hereinabove except for the hopper.

Hopper 18A of blast cleaning machine 10A comprises a front hopper wall 50, side hopper walls 52, a rear hopper wall 54, a front reducing wall 56, side reducing walls 58, a rear reducing wall 60, a front feed wall 62, side feed walls 64 and a rear feed wall 66. The front hopper wall 50 and the rear hopper wall 54 are parallel with the blast opening 24.

The front feed wall 62 and the rear feed wall 66 are also parallel with the blast opening 24. Moreover, the front feed wall 62, the side feed walls 64 and the rear feed wall 66 define a feed corridor which communicates straight into the blast assembly 14 and is centered with the longitudinal centerline of the hopper 18A.

The reducing walls 56, 58 and 60 connect the hopper walls 50, 52 and 54 with the feed walls 62, 64 and 66. Typically, the reducing walls 56, 58 and 60 extend outward from the feed walls 62, 64 and 66 at an angle of approximately 45 degrees.

Figure 5:
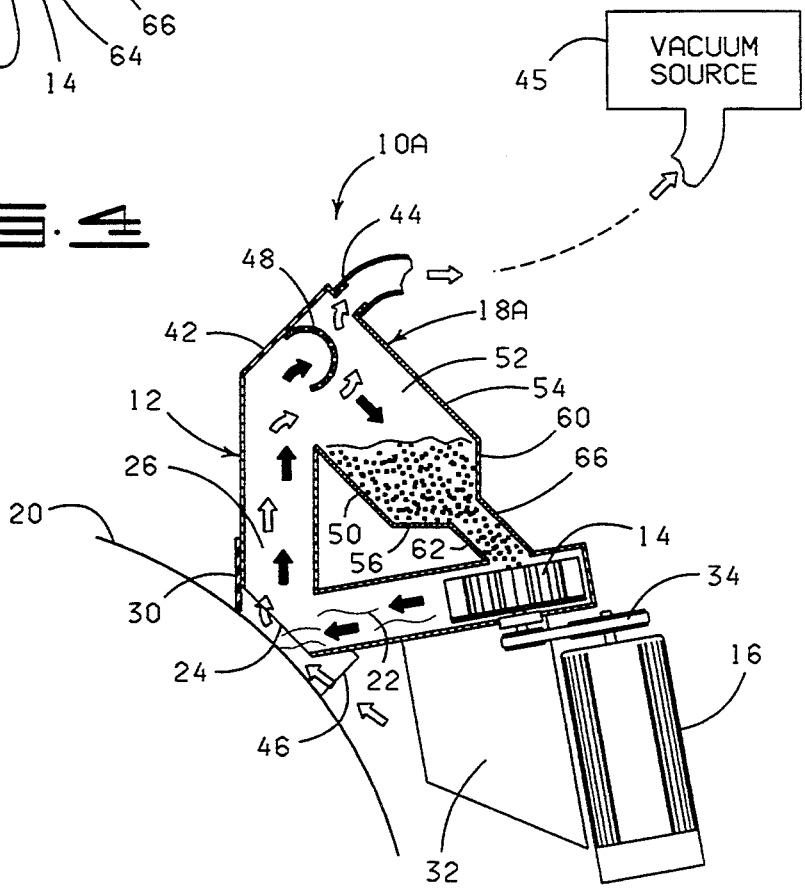
FIG. 5 is a partly sectional, partly diagrammatical side view of the blast cleaning machine of FIG. 4. The machine is positioned to blast angularly downward.
Figure 6:
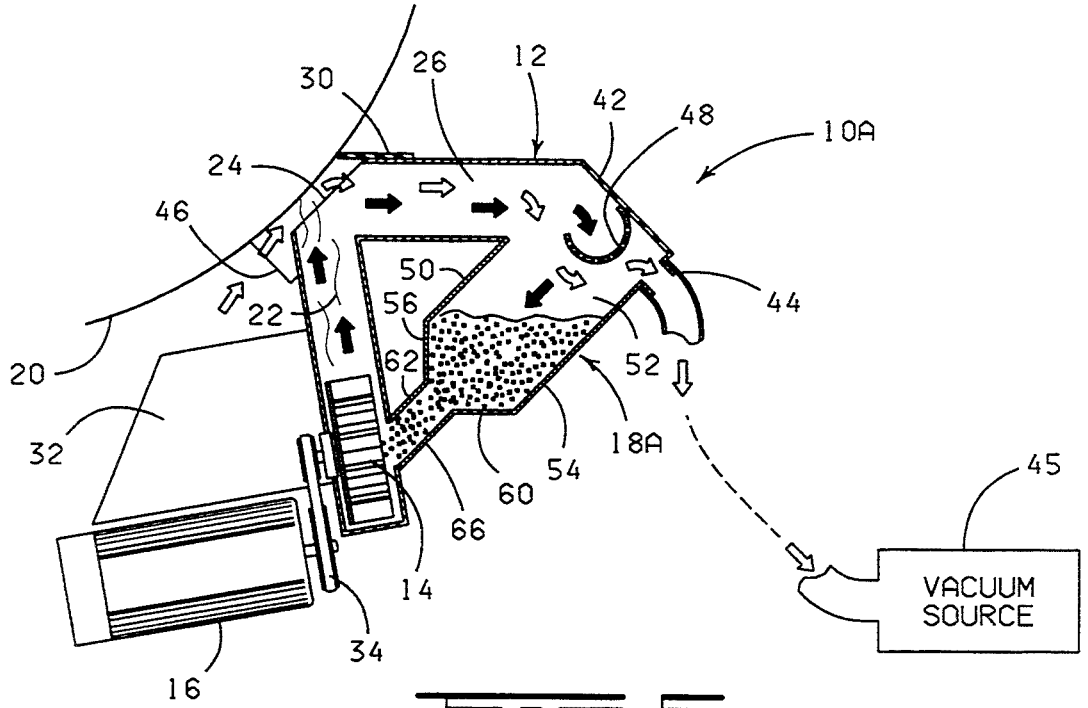
FIG. 6 is a partly sectional, partly diagrammatical side view of the blast cleaning machine of FIG. 4. The machine is positioned to blast laterally against a substantially vertical surface.
Figure 7:
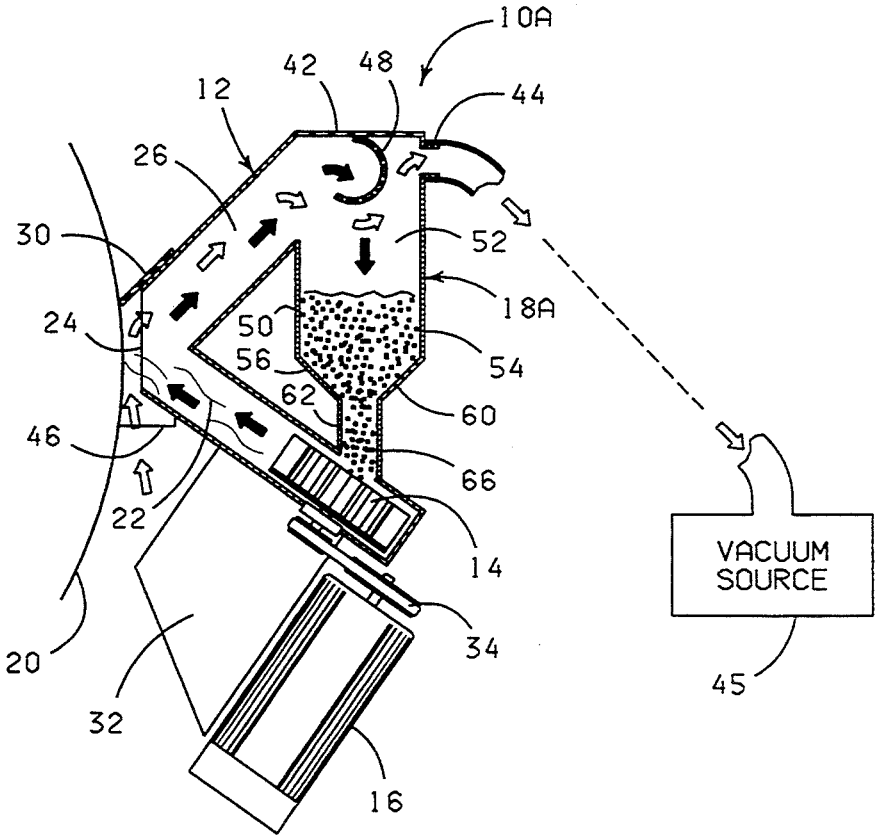
FIG. 7 is a partly sectional, partly diagrammatical side view of the blast cleaning machine of FIG. 4. The machine is positioned to blast angularly upward.

It should be noted that the vacuum duct 44 extends from the rear hopper wall 54 in order to draw abrasive material over the front hopper wall 50 of the hopper 18A. This construction is particularly important when the machine 10A is blasting angularly downward, as illustrated by FIG. 5.

In addition, it should be appreciated that the hopper 18A may be elongated in order to increase the capacity of the hopper 18A. Of course, the return corridor 26 should be elongated as well to connect with the upper front of the hopper 18A.

OPERATION

The operation of the blast cleaning machine 10A is similar to that described for the machine 10. The machine 10A, however, provides effective gravity feed of abrasive material when the machine is blasting angularly downward.

When blasting angularly downward at an angle of about 45 degrees or less (FIG. 5), the abrasive material gravity feeds along the front hopper wall 50, the front reducing wall 56 and the front feed wall 62 and into the blast assembly 14. It should be appreciated that the abrasive material travels a substantially straight path through the hopper 18A and into the blast assembly 14.

When blasting angularly upward at an angle of about 45 degrees or less (FIG. 6), abrasive material gravity feeds along the rear hopper wall 54, the rear reducing wall 60 and the rear feed wall 66. In this case, the abrasive material also travels a substantially straight path through the hopper 18A and into the blast assembly 14.

For blast cleaning a substantially vertical portion of the surface 20 (FIG. 7), the abrasive material gravity feeds along the front reducing wall 56 and the rear reducing wall 60. In this orientation of the machine 10A, it should be appreciated that the abrasive materials falls by gravity straight through the hopper 18A and into the blast assembly 14.

Changes may be made in the combinations, operations and arrangements of the various parts and elements described herein without departing from the spirit and scope of the invention as defined in the following claims.

What is claimed is:

1. An apparatus for blast cleaning a surface, the apparatus comprising:

a housing having a blast corridor, a return corridor and a blast opening, the blast opening communicating with the blast corridor and the return corridor;

blast means for propelling abrasive material through the blast corridor and the blast opening against a surface to be blast cleaned; and a hopper communicating with the return corridor to recover spent abrasive material and communicating with the blast corridor to supply abrasive material to said blast means, said hopper having a rear wall positioned to be substantially parallel with the blast opening and extending in a substantially straight line to said blast means;

wherein said housing and said hopper cooperate to gravity feed abrasive material from said hopper to said blast means when the blast opening is disposed against a surface oriented between about forty-five degrees over verticality and about forty-five degrees under verticality.

2. The apparatus of claim 1 further comprising:

an elastomeric seal mounted to said housing and surrounding the blast opening.

3. The apparatus of claim 1 further comprising:

vacuum means for creating an air flow traveling from the blast opening through the return corridor and out of said hopper.

4. The apparatus of claim 3 further comprising:

means, mounted within said hopper, for segregating debris of the blast cleaning from the abrasive material.

5. The apparatus of claim 3 further comprising:

an air louvre mounted to said housing and adapted to adjust the air flow created by said vacuum means.

6. An apparatus for blast cleaning a surface, the apparatus comprising:

a housing having a blast corridor, a return corridor and a blast opening, the blast opening communicating with the blast corridor and the return corridor;

blast means for propelling abrasive material through the blast corridor and the blast opening against a surface to be blast cleaned; and a hopper communicating with the return corridor to recover spent abrasive material, said hopper communicating with the blast corridor to supply abrasive material to said blast means, wherein said hopper comprises:

a front hopper wall substantially parallel with the blast opening;

a rear hopper wall opposite said front hopper wall and substantially parallel with the blast opening;

a front feed wall communicating with the blast corridor to direct abrasive material to said blast means, said front wall being substantially parallel to the blast opening;

a rear feed wall opposite said front feed wall and communicating with the blast corridor to direct abrasive material to said blast means, said front wall being substantially parallel with the blast opening;

a front reducing wall connecting said front feed wall and said front hopper wall; and a rear reducing wall connecting said rear feed wall and said rear hopper wall.

7. The apparatus of claim 6 wherein said front reducing wall extends between said front hopper wall and said front feed wall at an angle of approximately forty-five degrees.

8. The apparatus of claim 6 wherein said rear reducing wall extends between said rear hopper wall and rear feed wall at an angle of approximately forty-five degrees.

9. The apparatus of claim 6 further comprising:

an elastomeric seal mounted to said housing and surrounding the blast opening.

10. The apparatus of claim 6 further comprising:

vacuum means for creating an air flow traveling from the blast opening through the return corridor and out of said hopper.

11. The apparatus of claim 10 further comprising:

means, mounted within said hopper, for segregating debris of the blast cleaning from the abrasive material.

12. The apparatus of claim 10 further comprising:

an air louvre mounted to said housing and adapted to adjust the air flow created by said vacuum means.

13. The apparatus of claim 1 wherein said housing and said hopper define a substantially straight line path from said hopper to said blast means.

14. The apparatus of claim 1 wherein the rear wall of said hopper extends in a substantially straight line directly to said blast means.

15. An apparatus for blast cleaning a surface, the apparatus comprising:

a housing having a blast corridor, a return corridor and a blast opening, the blast opening communicating with the blast corridor and the return corridor;

blast means for propelling abrasive material through the blast corridor and the blast opening against a surface to be blast cleaned; and a hopper communicating with the return corridor to recover spent abrasive material and communicating with the blast corridor to supply abrasive material to said blast means, said hopper having a rear wall positioned to be substantially parallel with the blast opening and extending in a substantially straight line directly to said blast means.

16. The apparatus of claim 15 further comprising: an elastomeric seal mounted to said housing and surrounding the blast opening.

17. The apparatus of claim 15 further comprising:

means, mounted within said hopper, for segregating debris of the blast cleaning from the abrasive material.

18. The apparatus of claim 15 further comprising:

vacuum means for creating an air flow traveling from the blast opening through the return corridor and out of said hopper.

19. The apparatus of claim 18 further comprising:

an air louvre mounted to said housing and adapted to adjust the air flow created by said vacuum means.

* * * * *